US008011630B1

(12) United States Patent
Metcalf

(10) Patent No.: US 8,011,630 B1
(45) Date of Patent: Sep. 6, 2011

(54) HARDWARE DISPLAY CLIP

(75) Inventor: Keith E. Metcalf, Jasper, IN (US)

(73) Assignee: Design 4U, LLC, Jasper, IN (US)

( * ) Notice: Subject to any disclaimer, the term of this patent is extended or adjusted under 35 U.S.C. 154(b) by 881 days.

(21) Appl. No.: 12/028,256

(22) Filed: Feb. 8, 2008

(51) Int. Cl.
*A47B 96/06* (2006.01)

(52) U.S. Cl. ..... 248/231.81; 248/316.7

(58) Field of Classification Search ..... 248/231.8, 248/229.16, 229.26, 230.7, 316.7
See application file for complete search history.

(56) References Cited

U.S. PATENT DOCUMENTS

| | | | | |
|---|---|---|---|---|
| 556,592 | A | 3/1896 | Trachsel | |
| D113,169 | S | 1/1939 | Miller | |
| 2,447,389 | A | 8/1948 | Borchers | |
| 3,484,910 | A | 12/1969 | Gossling | |
| 3,591,118 | A | 7/1971 | Gentile | |
| 3,615,046 | A | 10/1971 | Bashara | |
| 3,669,394 | A | 6/1972 | Loucks | |
| 4,059,190 | A | 11/1977 | Conway | |
| 4,279,396 | A * | 7/1981 | Bendock | 248/205.5 |
| D260,480 | S | 9/1981 | DeMars | |
| 4,860,905 | A | 8/1989 | Schott et al. | |
| D304,545 | S | 11/1989 | Hurrelbrink | |
| D326,021 | S | 5/1992 | Evenson | |
| 5,582,360 | A | 12/1996 | Herman | |
| 5,607,230 | A * | 3/1997 | Protz, Jr. | 362/396 |
| 5,695,162 | A * | 12/1997 | DiCastro | 248/231.81 |
| 5,772,166 | A | 6/1998 | Adams | |
| 6,364,260 | B1 | 4/2002 | Lorinez et al. | |
| 6,663,069 | B1 | 12/2003 | Norberg | |
| 6,669,241 | B1 | 12/2003 | Kelley | |
| 7,472,561 | B2 * | 1/2009 | Biggers et al. | 62/285 |
| 2006/0175503 | A1 | 8/2006 | Simonsen | |
| 2006/0186291 | A1 * | 8/2006 | Conway | 248/231.81 |
| 2010/0012804 | A1 * | 1/2010 | Egan | 248/231.81 |

OTHER PUBLICATIONS

Merchandising Inventives, Inc; Gripper Wire Sign Holder #GWFSH-1C; Internet Web Site: http://merchinv.com; US.

* cited by examiner

*Primary Examiner* — Ramon Ramirez
(74) *Attorney, Agent, or Firm* — Robert Theuerkauf; Middleton Reutlinger

(57) ABSTRACT

A hardware accessory display clip is provided that enables hardware accessories to be displayed on a number of different products without damage to the hardware accessories or products. An integrally connected exterior leg, interior leg, and bridge portion are provided that enables the hardware accessory display clip to be removably attached to a variety of products. An accessory connector member is integrally formed in the exterior leg of the hardware accessory display clip that can be removably received in a variety of hardware accessories.

27 Claims, 5 Drawing Sheets

HARDWARE DISPLAY CLIP

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention is related generally to display clips and more specifically to display clips for hardware accessories for products such as cabinets, drawers, and doors.

2. Description of the Related Art

Display of products is known to be a key element of sales to potential customers. With regards to displays of hardware accessories, for example knobs, pulls, handles and the like, for products such as cabinets, drawers, and doors, the items are traditionally displayed on sections of wood, simulated wood, or another backdrop alongside other hardware accessories. The hardware accessories are attached using bolts, screws, tape, glue, and other like means. This traditional way for displaying hardware accessories has several drawbacks. Consumers must view the hardware accessories against the backdrop the store has chosen or obtain one of the hardware accessories that are for sale, which are oftentimes packaged, and place it by hand against another available backdrop in the store. Additionally, if a consumer currently purchases a hardware accessory and wants to see how it looks with a product in another store or an existing product the consumer has at home, they must hold the hardware accessory next to the product or drill holes to mount the product, or use some other damaging means to mount the product.

Thus, there is a need for a hardware accessory display clip that can removably receive a hardware accessory and be removably attached to a variety of products, such as cabinets, drawers or doors for which the accessory is designed. Such a display clip will enable a consumer to view a hardware accessory with a variety of products or a store to display a hardware accessory with a variety of products without physically holding the hardware accessory or using tools or damaging means to mount the accessory.

SUMMARY OF THE INVENTION

Some embodiments of the invention allow hardware accessories to be displayed on a variety of products without using tools or damaging the hardware accessories or products.

Some embodiments of the invention provide a hardware accessory display clip comprising an exterior leg, an interior leg, a bridge portion, all integrally connected in a u-shaped configuration, and an accessory connector mounted to the exterior leg, where the accessory connector provides a releasable interference fit with a hardware accessory.

A hardware accessory display clip may be formed from a resilient or elastic material and may comprise an exterior leg, an interior leg, and a bridge portion, with the exterior leg and the interior leg integrally connected to the bridge portion in generally a u-shaped configuration; the exterior leg may have a substantially cylindrical connector for providing a releasable interference fit with a hardware accessory; the interior leg or the exterior leg may be at an angle to the bridge portion and may have a surface which provides a frictional force against an object, such as a cabinet drawer or door, placed between said exterior leg and said interior leg.

Some embodiments of the invention may provide a hardware accessory display clip that can be adapted to be used on products of various thickness, with accessories having various size mounting apertures, and to place hardware accessories at various positions on a given product.

Some embodiments of the invention provide a hardware accessory display clip which may have an exterior leg, an interior leg, and a bridge portion, all integrally connected and formed from a resilient material, where the exterior leg may have a first end, a second end, a substantially flat interior surface, and an exterior surface with an accessory connector integrally formed thereto. The interior leg may have a first end, a second end, an exterior surface, and an interior surface facing the interior surface of the exterior leg, where the interior surface of the interior leg may have a protrusion integrally formed thereto which may provide friction against an object placed between said exterior leg and said interior leg. The bridge portion may have an interior surface, an exterior surface, a middle portion and two curved connecting portions. The bridge portion may also have a protrusion portion extending along the same plane of the middle portion of said bridge portion. Additionally, the bridge portion may have a brace extending to at least one of the interior leg, exterior leg or protrusion portion of the bridge portion.

A method of displaying hardware accessories for sale may comprise attaching in a temporary manner a hardware accessory to at least one display clip; attaching in a temporary manner the display clip to a product for viewing a combination of the product and the hardware accessory, wherein said display clip contacts opposing sides of said product and is removably attached without using tools and without damaging or permanently altering the hardware accessory or the product.

Other objects and advantages will become apparent from the following description taken in connection with the accompanying drawings, wherein is set forth, by way of illustration and examples, embodiments of this invention.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
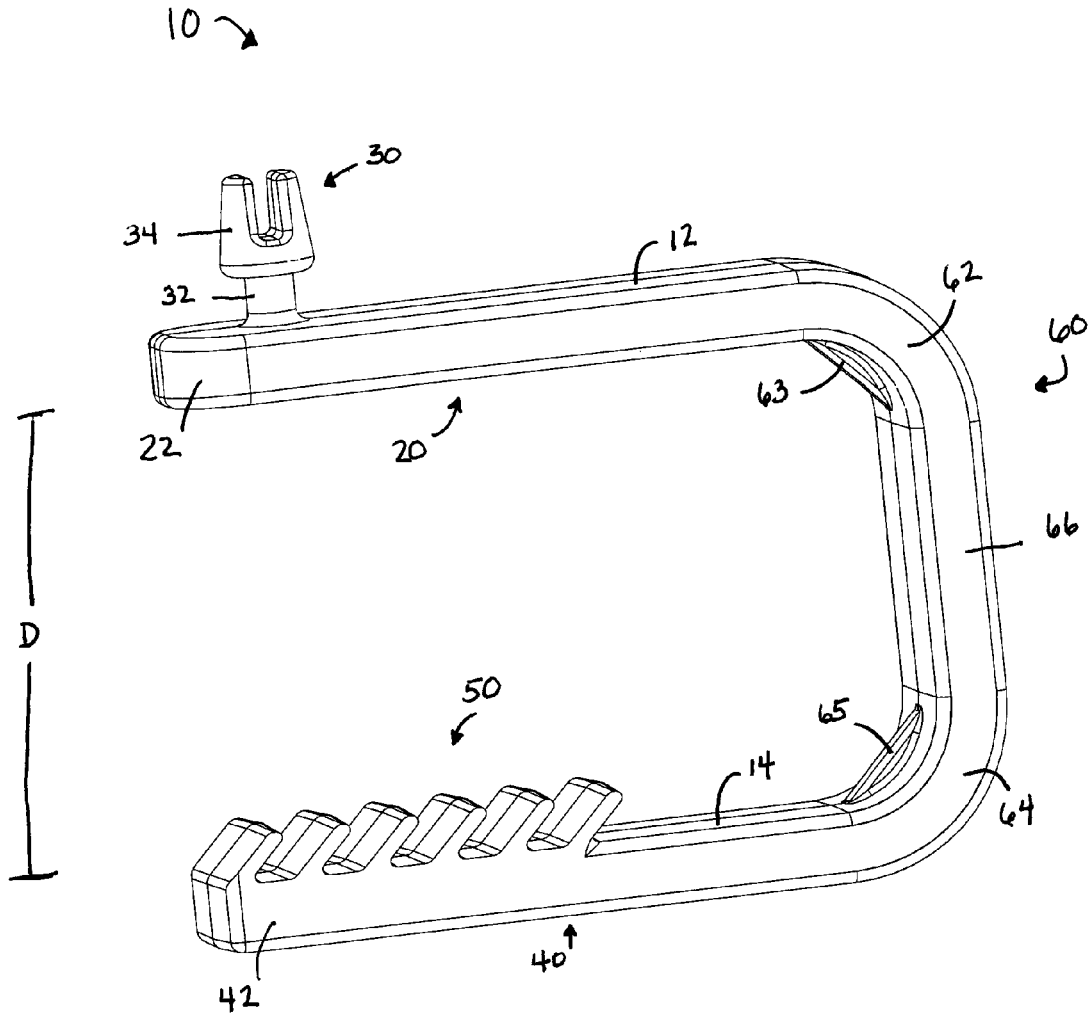
FIG. 1 is a perspective view of an exemplary clip.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific mechanical configurations illustrated in the drawings are intended to exemplify embodiments of the invention and that other alternative mechanical configurations are possible.

Figure 2:
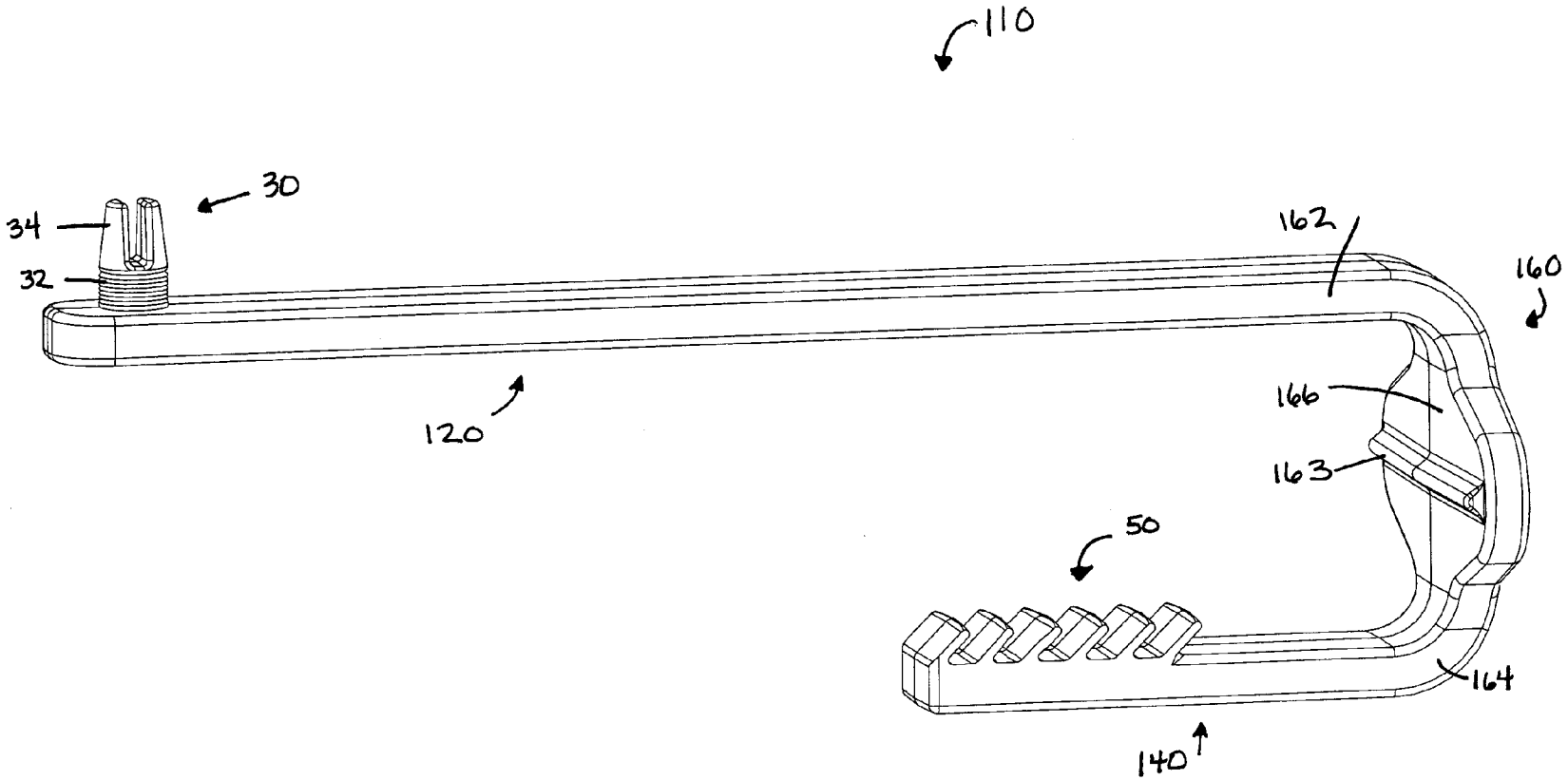
FIG. 2 is a perspective view of an alternative embodiment of a display clip.
Figure 3:
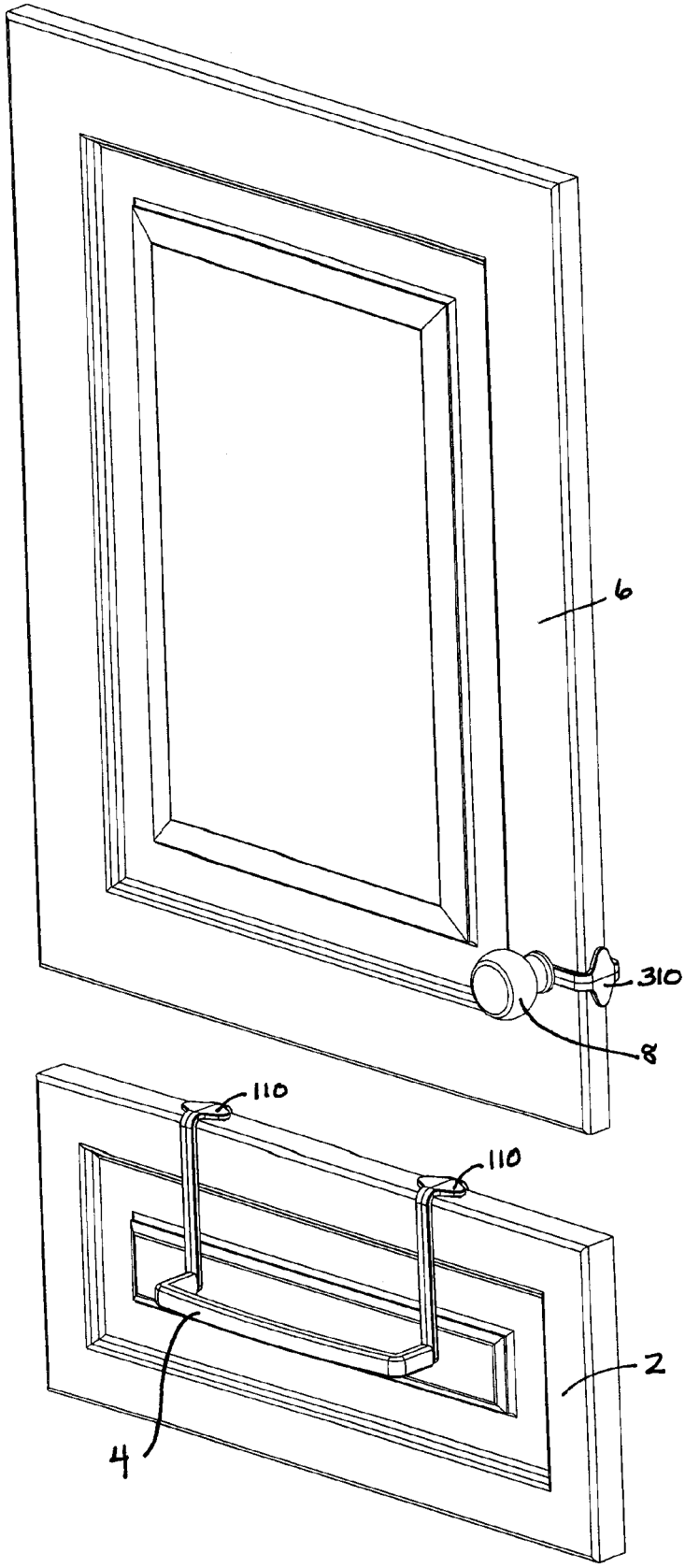
FIG. 3 is a perspective view of exemplary clips, with exemplary hardware accessories attached, in use on an exemplary cabinet door and cabinet drawer.

Referring now in detail to the drawings, wherein like numerals indicate like elements throughout the several views, there are shown in FIGS. 1-5 various aspects of a hardware display clip. The hardware display clip of the present description provides a design that will allow various hardware accessories, such as knobs, pulls, handles and the like, to be mounted to, and displayed, on various products, such as cabinet drawers, doors and the like, without the need for physically holding the accessory or using tools to mount such hardware accessories (as seen in FIG. 3 for example). Further, the hardware display clip allows such hardware accessories to be mounted without damaging the hardware accessory or the product to which it is mounted.

Referring to FIG. 1, one embodiment of a hardware accessory display clip 10 is shown. The hardware accessory display clip 10 has an exterior leg 20, an interior leg 40, and a bridge portion 60 that are integrally formed and may be molded as a single piece. According to the exemplary embodiment, hardware accessory display clip 10 is substantially U-shaped. The hardware accessory display clip 10 is formed from a resilient material, such as a substantially translucent plastic that minimally inhibits the view of any product to which hardware accessory display clip 10 is attached. However, one skilled in the art will realize that other materials may be substituted herein and are well within the scope of the present invention. Both legs 20 and 40 have a free first end 22 and 42, respectively, as well as a second end integrally connected to bridge portion 60. The bridge portion 60 has a middle portion 66, an exterior leg connecting portion 62, and an interior leg connecting portion 64. Interior and exterior leg connecting portions 64 and 62 are depicted as being curved, although they could take on a variety of shapes appropriate to connect middle portion 66 to legs 40 and 20, respectively.

Continuous across the exterior leg 20, the interior leg 40, and the bridge portion 60 is interior surface 14, which encompasses the entire inner facing surface portion of hardware accessory display clip 10. Also continuous across the exterior leg 20, the interior leg 40, and the bridge portion 60 is an exterior portion 12. The exterior portion 12 encompasses the entire outer facing surface of hardware accessory display clip 10 as well as the sidewall that joins interior surface 14 and the outer facing surface. The resilient nature of hardware accessory display clip 10 allows at least portions of the exterior leg 20 and the interior leg 40 to move outwardly as they are inserted on products of various thicknesses, such as for example cabinet drawers, doors or the like, while still enabling portions of the interior surface 14 to be interference fit with the product and allowing hardware accessory display clip 10 to sufficiently grip the product.

The hardware accessory display clip 10 comprises an unattached distance D between the exterior leg 20 and the interior leg 40. The resilient nature of the hardware accessory display clip 10 allows the legs 20 and 40 to move outwardly to accommodate products whose thickness is somewhat greater than the unattached distance D between legs 20 and 40, the unattached distance D between legs 20 and 40 can also be adjusted to accommodate products whose thickness varies a great deal. For example, placement of hardware accessory display clip 10 on a door for preview of a door handle or knob requires the distance between the exterior leg 20 and the interior leg 40 to be much greater than distance required for placement on a thin cabinet door or drawer. Thus, the hardware accessory display clips 10 can be provided for each function by adjusting the length of the bridge portion 60 so as to create an appropriate distance between the legs 20 and 40. Similarly, hardware accessory display clips 10 can be provided that allow placement of hardware accessories various distances in from the edge of a product. This is accomplished, as shown in FIG. 2 for example, by independently adjusting the lengths of the exterior leg 20 and the interior leg 40 to accommodate a particular hardware accessory placement need. Such adjustments enable the display clip to be used on a wide range of products to display hardware accessories.

Figure 4:
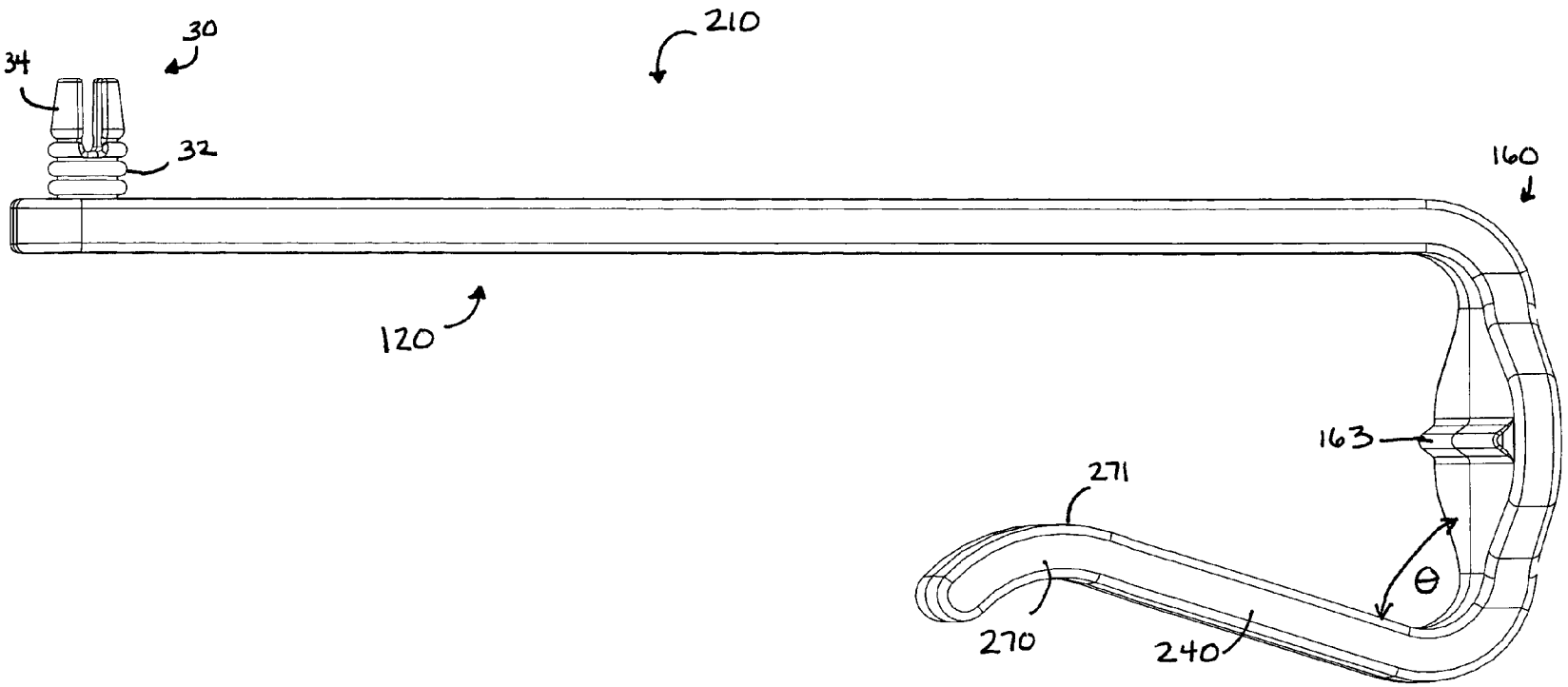
FIG. 4 is a perspective view of an alternative embodiment of a display clip.
Figure 5:
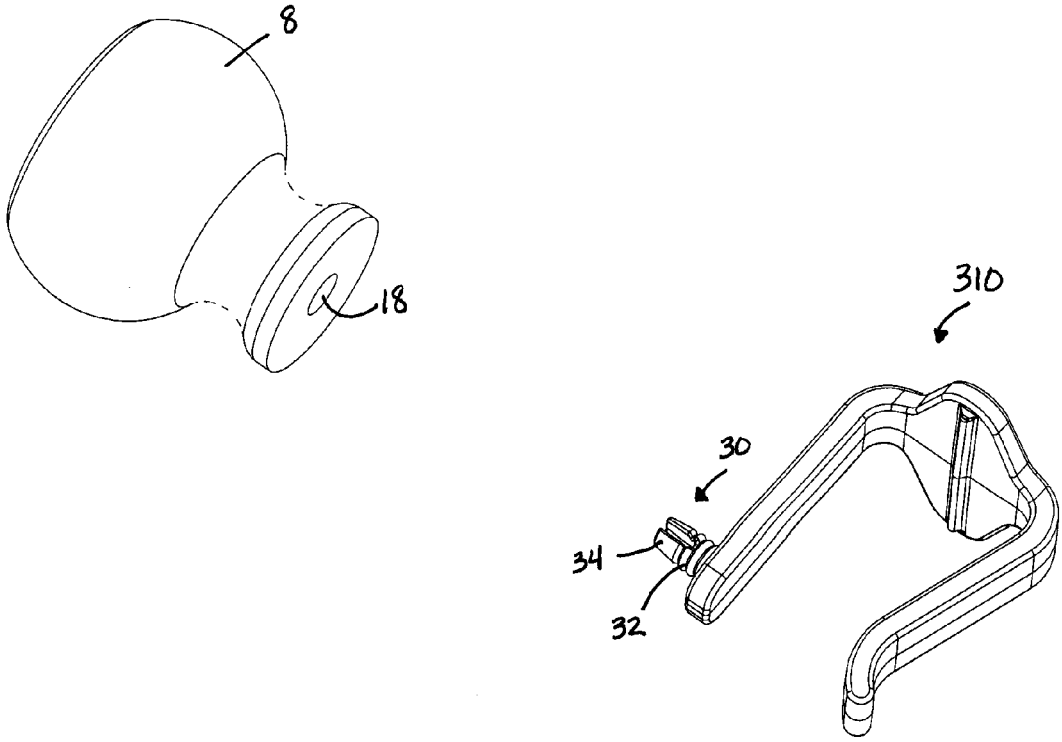
FIG. 5 is a perspective view of an exemplary display clip and a hardware accessory.

Integrally formed in the exterior surface 12 of the exterior leg 20 is an accessory connector 30. The accessory connector 30 is receivable in the mounting aperture 18 of a corresponding hardware accessory 8 (FIG. 5) and the interference fit between the connector and the accessory is sufficient to allow the hardware accessory to be maintained on the accessory connector 30, yet removed with appropriate force from a user. Accessory connector 30 can take on a number of sizes and shapes to enable the accessory connector 30 to sufficiently hold the hardware accessory, and to allow the accessory connector 30 to releasably maintain the hardware accessory. The accessory connectors 30 depicted in FIG. 1, FIG. 2, FIG. 4, and FIG. 5 have an integrally proximal portion 32 and a tapered top or distal portion 34. Proximal portion 32 of FIG. 1 is shown having a relatively smooth surface and a smaller diameter than the base of tapered distal portion 34. However, as shown in FIG. 2, FIG. 4 and FIG. 5, proximal portion 32 is preferably provided with a plurality of ribs or other protrusions on its exterior surface and is of a similar diameter to that of the base of distal portion 34. The ribs may be provided in proximal portion 32 to provide for better interference fit with a hardware accessory or to enable a hardware accessory to be threaded onto accessory connector 30. Ribs may likewise be provided on all or portions of tapered distal portion 34.

Accessory connector 30 is also preferably provided with a void in at least a portion of tapered distal portion 34. Tapered distal portion 34 of FIG. 1 is shown having a void taken through the center, extending about three fourths of the way down from the top tapered end. However, accessory connector 30 could also be provided with a void that extends further down tapered distal portion 34, such as the void shown in FIG. 2, or provided with a void that extends into proximal portion 32, such as the void shown in FIG. 4, or provided without a void at all. The void of accessory connector 30 and the resilient nature of accessory connector 30 allow the two pieces the void separates to move toward each other and enables accessory connector 30 to be securely received into the mounting aperture of a hardware accessory. While the shape and resilient nature of the accessory connector 30 ensures a tight fit with the aperture of the hardware accessory, it likewise enables the attached hardware accessory to be removed with adequate force from a user. Thus, by placing the aperture of a hardware accessory over accessory connector 30 and applying adequate force, the hardware accessory will receive accessory connector 30 and by applying adequate force in the opposite direction, the hardware accessory can be removed. The resilient nature of the accessory connector 30 enables this to be done without damage to the hardware accessory.

Of course, the shape, width, and height of the accessory connector 30 can be adjusted to enable the accessory connector 30 to receive a variety of hardware accessories. This enables a wide range of hardware accessories to securely receive the accessory connector 30, and allows the accessory connector 30 to releasably maintain the hardware accessory. Also, as depicted in FIG. 3, the hardware accessory display clip can be used to preview hardware accessories that have multiple mounting apertures. For example, as depicted, two hardware accessory display clips 110 are utilized in conjunction with a drawer 2 to preview the depicted exemplary drawer pull 4 having two mounting apertures. FIG. 3 also shows a single hardware accessory display clip 310 utilized in conjunction with a cabinet 6, to preview the depicted cabinet knob 8.

Although not necessary, preferably integrally formed on the interior surface 14 of exterior leg connecting portion 62, and an interior leg connecting portion 64 are exterior leg brace 63 and interior leg brace 65, respectively, shown on the hardware accessory display clip 10 of FIG. 1. The exterior and interior leg braces 63 and 65 are protrusions that extend from the exterior and interior legs 20 and 40, respectively, to the middle portion 66 of the bridge portion 60. The exterior and interior leg braces 63 and 65 provide extra rigidity to the exterior and interior leg connecting portions 62 and 64, while still allowing exterior leg 20 and interior leg 40 to move outwardly for placement on a product. When the hardware accessory display clip 10 is attached to a product, the additional rigidity further increases the pressure exterior and interior leg 20 and 40 exert on the product.

A friction member or protrusion 50 may be integrally formed along the interior surface 14 of the interior leg 40 as shown most clearly in FIG. 1 and FIG. 2. Depicted friction member 50 consists of ribs protruding at an angle towards bridge portion 60. When hardware accessory display clip 10 is attached to a product, one or more of the ribs of friction member 50 will be in contact with the product to help maintain hardware accessory display clip 10 in position. Although the depicted friction member 50 is illustrated as ribs angled toward bridge portion 60, the ribs could also be parallel with or angled away from bridge portion 60. Likewise, friction member 50 could consist of a single rib or one or more raised bumps, textured bumps, or one or more other protrusions. Further, although to friction member 50 is shown on interior leg 40 it also could be formed along the interior surface 14 of exterior leg 20.

Turning now to FIG. 2, an alternative embodiment of the hardware accessory display clip 110 is shown. The hardware accessory display clip 110 of FIG. 2 has an exterior leg 120 that is of greater length than interior leg 140 to allow a hardware accessory to be attached farther away from a bridge portion 160. The bridge portion 160 of hardware accessory display clip 110 also differs in that the width of a portion of the bridge portion 160 is of greater width than the remainder of the hardware accessory display clip 110. In particular, middle portion 166 and portions of leg connecting portion 162 and interior leg connecting portion 164 are wider than the remainder of the hardware accessory display clip 110. The increased width of a portion of the bridge portion 160 prevents excessive rotation of the hardware accessory display clip 110 when it is attached to a product. Contact between bridge portion 160 and the side of the product adjacent bridge portion 160 impedes rotation that may be caused by the weight of any attached hardware accessory. Further, bridge portion 160 has a brace 163 to provide extra rigidity to bridge portion 160. Although the exterior leg 120 is shown as having a greater length than interior leg 140, it could be of lesser length than the interior leg 140. Moreover, either leg could have one or more curves or bends or be angled inwardly or outwardly when the hardware accessory display clip 110 is in the unattached position. Since the hardware accessory display clip 110 is formed from a resilient material, preferably resilient plastic, any of these variations of the legs still enables them to be moved outwardly around a product and their resilient nature causes the legs to grip the product as they attempt to return to their unattached state.

Turning now to FIG. 4, a further alternative embodiment of the hardware accessory display clip 210 is shown. The hardware accessory display clip 210 of FIG. 4 has an interior leg 240 that protrudes or is angled toward the exterior leg 120. The protrusion or angle Θ between interior leg 240 and the bridge portion 160 is less than 90 degrees. Further, the distal end of interior leg 240 has a curved or knee portion 270 having a surface 271 that engages the product on which it is installed. The resilient nature of the hardware accessory display clip 210 allows the legs 120 and 240 to move outwardly to accommodate products whose thickness is greater than the unattached distance between legs 120 and 240. The unattached distance between legs 120 and 240 is such that when mounted the legs firmly grip to the product on which it is installed to maintain hardware accessory display clip 210 in position. Moreover, the unattached distance between legs 120 and 240 can be adjusted to accommodate products whose thickness varies a great deal.

In use, for example, an individual in a store selling multiple styles and types of both hardware accessories (such as pulls, knobs or handles) and products (such as cabinet drawers or doors) can temporarily attach a hardware accessory to at least one hardware accessory display clip and temporarily attach the hardware accessory display clip to a product for viewing a combination of the product and the hardware accessory. The store, a hardware accessory manufacturer, or a product manufacturer, can make the hardware accessory display clips available for the individual's or store employee's use. The hardware accessory is pushed onto (or can be threaded onto) the display clip by the individual or store employee without the use of tools. Then the display clip is attached to a product, such as a cabinet door. The hardware accessory display clip securely contacts opposing sides of the product and therefore is removably attached without using tools and without damaging or permanently altering the hardware accessory or the product. This allows the individual to view a selected hardware accessory on a selected product without the need to hold the hardware accessory or use tools to mount the hardware accessory. Moreover, this allows the individual to view the hardware accessory and product combination without damaging either the hardware accessory or the product.

The foregoing description of structures and methods has been presented for purposes of illustration. It is not intended to be exhaustive or to limit the invention to the precise steps and/or forms disclosed, and obviously many modifications and variations are possible in light of the above teaching. It is understood that while certain forms of the hardware accessory display clip have been illustrated and described, it is not limited thereto except insofar as such limitations are included in the following claims and allowable functional equivalents thereof.

What is claimed is:

1. A hardware display clip, comprising:

an exterior leg, an interior leg, and a bridge portion, said exterior leg and said interior leg integrally connected to said bridge portion in generally a u-shaped configuration;

said exterior leg having an accessory connector mounted thereto;

said accessory connector having a tapered distal portion and a proximal portion;

said tapered distal portion having a base connected to said proximal portion;

said accessory connector providing a releasable interference fit with a hardware accessory.

2. The hardware display clip of claim 1 wherein said accessory connector is substantially cylindrical.

3. The hardware display clip of claim 1 wherein said tapered distal portion has a generally frusto-conical shape and at least one cross sectional void.

4. The hardware display clip of claim 3 wherein said cross sectional void has a first width when disengaged from said hardware accessory and a second width when engaged with said hardware accessory, said first width being greater than said second width.

5. The hardware display clip of claim 1 wherein said proximal portion is ribbed.

6. The hardware display clip of claim 1 wherein said accessory connector is deformable for releasably engaging said hardware accessory.

7. The hardware display clip of claim 1 wherein one of said interior leg or said exterior leg has a protrusion for providing a frictional force against an object placed between said interior leg and said exterior leg.

8. The hardware display clip of claim 7 wherein said protrusion further comprises a plurality of ribs protruding from one of said interior leg or said exterior leg.

9. The hardware display clip of claim 1 wherein a portion of said interior leg is disposed at an angle to said bridge portion, said angle being less than 90 degrees.

10. The hardware display clip of claim 9 wherein said portion of said interior leg has a knee portion for providing a frictional force against an object placed between said interior leg and said exterior leg.

11. The hardware display clip of claim 1 wherein said bridge portion has a brace, said brace extending from said bridge portion to one of said interior leg or said exterior leg.

12. The hardware display clip of claim 1 wherein said u-shaped configuration is formed from a resilient material.

13. The hardware display clip of claim 12 wherein said resilient material is substantially translucent.

14. The hardware display clip of claim 1 wherein said bridge portion has a protrusion portion extending generally perpendicular to said first and second legs.

15. The hardware display clip of claim 14 wherein said bridge portion has a brace extending from said bridge portion to said protrusion portion.

16. A hardware display clip, comprising:

a generally u-shaped configuration formed from an elastic material;

said u-shaped configuration having an exterior leg and an interior leg;

said exterior leg having a substantially cylindrical connector for providing a releasable interference fit with a hardware accessory;

one of said exterior leg or said interior leg having a surface for providing a frictional force against an object placed between said exterior leg and said interior leg.

17. The hardware display clip of claim 16 wherein said substantially cylindrical connector has a tapered distal portion.

18. The hardware display clip of claim 17 wherein said tapered distal portion has a generally frusto-conical shape and at least one cross sectional void.

19. The hardware display clip of claim 16 wherein said substantially cylindrical connector has a ribbed proximal portion.

20. The hardware display clip of claim 16 wherein said substantially cylindrical connector is deformable for releasably engaging said hardware accessory.

21. The hardware display clip of claim 16 wherein said surface comprises a plurality of ribs protruding from one of said interior leg or exterior leg.

22. The hardware display clip of claim 16 wherein said elastic material is substantially translucent.

23. A method of displaying hardware accessories for sale, comprising:

attaching in a temporary manner a hardware accessory to at least one display clip, said display clip having an accessory connector with a tapered distal portion and a proximal portion, said tapered distal portion having a base connected to said proximal portion, without using tools and without permanently altering said hardware accessory;

attaching in a temporary manner said at least one display clip and said hardware accessory to a product without using tools and without permanently altering said product, for viewing a combination of said product and said hardware accessory.

24. The method of claim 23 wherein said product is one of a cabinet door or a cabinet drawer.

25. The method of claim 24 wherein said hardware accessory is a cabinet hardware.

26. The method of claim 23 wherein said product is a door.

27. The method of claim 26 wherein said hardware accessory is a door knob.

* * * * *